US006895878B2

(12) United States Patent
Stutznacker

(10) Patent No.: US 6,895,878 B2
(45) Date of Patent: May 24, 2005

(54) CHAIN STITCH MULTI-NEEDLE QUILTING MACHINE AND METHOD TO CREATE A PATTERN IN A QUILTING MATERIAL

(75) Inventor: Klaus Stutznacker, Frechen (DE)

(73) Assignee: Nahmaschinenfabrik Emil Stutznacker GmbH & Co. KG, Cologne (DE)

( * ) Notice: Subject to any disclaimer, the term of this patent is extended or adjusted under 35 U.S.C. 154(b) by 469 days.

(21) Appl. No.: 09/971,503

(22) Filed: Oct. 5, 2001

(65) Prior Publication Data

US 2004/0000261 A1 Jan. 1, 2004

(30) Foreign Application Priority Data

Feb. 14, 2001 (DE) ..... 101 07 101
Mar. 22, 2001 (DE) ..... 101 13 955
May 23, 2001 (DE) ..... 101 25 108

(51) Int. Cl.[7] ..... D05B 11/00
(52) U.S. Cl. ..... 112/117; 112/165
(58) Field of Search ..... 112/117, 197, 112/200, 165, 166, 167, 284, 220, 221, 475.17, 475.08, 271, 274–277

(56) References Cited

U.S. PATENT DOCUMENTS 3,669,045 A * 6/1972 Landoni ..... 112/118
3,763,806 A * 10/1973 Shuffield ..... 112/226
4,089,281 A * 5/1978 Landoni ..... 112/221
4,474,124 A * 10/1984 Yamazawa ..... 112/167
5,005,499 A 4/1991 Landoni
5,154,130 A * 10/1992 Gribetz et al. ..... 112/292
5,269,238 A * 12/1993 Landoni ..... 112/117
5,505,150 A * 4/1996 James et al. ..... 112/475.01
5,509,365 A 4/1996 Cash
5,522,331 A 6/1996 Stutznäcker
6,435,117 B2 * 8/2002 Codos et al. ..... 112/475.08

FOREIGN PATENT DOCUMENTS

EP 0394601 A1 10/1990
EP 0727519 A1 8/1996
EP 1006229 * 6/2000
JP 04018158 1/1992
JP 2001038077 2/2001

* cited by examiner

*Primary Examiner*—Ismael Izaguirre
(74) *Attorney, Agent, or Firm*—Fish & Richardson P.C.; Richard P. Gilly

(57) ABSTRACT

The invention relates to a chain stitch multi-needle guilting machine with stitch-forming quilting elements and a method for creating a pattern in a guilting material. The elements of the quilting machine are comprised of at least one needle bar with attached needles and at least one looper shaft with attached loopers. Each of the needles and the loopers have a corresponding needle thread and looper thread associated therewith, form quilting element pairs, and are driven to build chain stitches in a quilting material. At least one of the needles is adjustable between two positions and participates in the quilting procedure in a first position and does not prick into the quilting material in the second position during the quilting procedure. The quilting machine can be made to have a device to knot the needle thread with the looper thread, or a device to cut the looper thread, or both.

57 Claims, 4 Drawing Sheets

CHAIN STITCH MULTI-NEEDLE QUILTING MACHINE AND METHOD TO CREATE A PATTERN IN A QUILTING MATERIAL

BACKGROUND OF THE INVENTION

Different multi-needle quilting machines are well-known from the state of the art technology. In this connection, so-called lock stitch multi-needle quilting machines must be distinguished from chain stitch multi-needle quilting machines. For example, U.S. Pat. No. 5,005,499 shows a lock stitch multi-needle quilting machine with one or more needle bars, each provided with a multitude of stitch forming needles. In case of this pre-known lock stitch multi-needle quilting machine, single needles can be moved, dependent on the pattern to be quilted, back and forth between two positions by means of pneumatic cylinders; whereby these needles participate in a first position in the quilting procedure, and are lifted in a second position in such a way that they do not prick into the quilting material during the quilting procedure.

With the chain stitch or double chain stitch, a needle takes a thread to the deepest point of its movement and forms a thread loop during the following upward movement. Whereas the needle returns to its highest position after the forming of the thread loop, a looper enters the thread loop with a looper thread. During the transport of the quilting material to the next stitch in quilting direction and the next downward movement of the needle, the looper is turned back to its initial position, whereas the needle stitches into a thread triangle spread out by the thread loop and the looper thread, thus forming a chain link of the chain stitch seam.

Compared with the lock stitch, the chain stitch or double chain stitch has the advantage forming smooth seams and largely avoiding the so-called displacement crimping as, contrary to the lock stitch, the tangle of needle and looper thread is not dragged into the quilting material but located on the bottom of the quilting material. Moreover thinner sewing threads can be used with chain stitches or double chain stitches compared to the lock stitch. Furthermore the chain stitch or double chain stitch has the advantage in comparison with the lock stitch that the needle thread is subject to an abrasion considerably lower resulting from the fact that less thread is pulled back and forth through the needle's eye per stitch forming with the double chain stitch. Altogether the chain stitch or double chain stitch shows the larger strength compared to the lock stitch. The disadvantage with the chain stitch or double chain stitch consists that even insignificant slip stitches or a thread break in the area of the needle and/or looper thread leads to that the thread chain can easily be opened.

Several chain stitch multi-needle quilting machines with stitch forming quilting elements are well-known from the state of the art technology. Generally, such chain stitch multi-needle quilting machines comprise one or more needle bars with attached needles as well as looper shafts, which number corresponds to the number of needle bars with attached loopers. Needle bars and looper shafts are located on the opposite sides of a quilting material support formed as perforated plate with a tap hole for each needle provided in the quilting material support. Most different patterns can be made in a quilting material with such chain stitch multi-needle machines. In this connection, even patterns can be made having single, each identical or different pattern elements being located distantly from each other.

In order to create such kind of patterns in a quilting material it is well-known to move the quilting material on the quilting material support not only in the main quilting direction but also oppositely and at least in a right angle to it. The forming of chain stitches and double chain stitches requires that each stitch is performed accurately so that highest care regarding the forming of a seam is provided. If, for example, several pattern elements are arranged in a quilting material distantly from each other, the quilting material will be moved to a position where the next pattern element is to be quilted after the first pattern element is finished. The needle bar bearing the needles is in a lifted position and the looper shaft bearing the loopers in a returned position. During this procedure, the looper thread, pulled off from a bobbin, is guided along the bottom of the quilting material without being connected with the quilting material in this area.

It could be optionally intended with chain stitch multi-needle quilting machines that the needle thread is cut by a cutting device after one pattern element is finished and that a completely new quilting procedure is initiated at the beginning of the next pattern element.

SUMMARY OF THE INVENTION

Starting from this state of the art technique, the invention is based on the object to develop a chain stitch multi-needle quilting machine or a method to create a pattern in a quilting material in such a way that additional and/or supplementary patterns could be easily quilted into the quilting material. Furthermore, a chain stitch multi-needle quilting machine according to the invention should be adaptable to predetermined quilting tasks.

With type-pursuant chain stitch multi-needle quilting machines, the solution of this problem provides that at least one, preferably a multitude of needle(s) are adjustable between two positions, with the needle(s) participating in a first position in the quilting procedure, and not pricking into the quilting material in a second position during the quilting procedure, and a device to knot the needle thread with the looper thread and/or a cutting device for the needle and/or looper thread being allocated to at least one of the needles adjustable between the two positions.

Therefore the arrangement of liftable needles to chain stitch multi-needle quilting machines is intended according to the invention. It must be considered in this connection that the needles could be lifted during the quilting procedure with lock stitch machines, what is not possible with the forming of chain stitches as this would produce slip stitches facilitating the opening of the thread chain. Besides the possibility of adjusting the single needles between two positions, it is necessary with chain stitch multi-needle quilting machines in order to secure the chain stitch seam that a device to knot the needle thread with the looper thread is provided at least in the area of the adjustable needles to avoid the automatic opening of the thread chain in this area. Optionally or supplementary to this device a cutting device for the needle and/or looper thread can be provided facilitating at least the needle thread being cut with an appropriate length before or after knotting without the risk of the automatic opening of the thread chain or the chain stitch seam. Thus, the invention represents a combination of a chain stitch multi-needle quilting machine with liftable needles, a device to knot the needle thread and/or a cutting device for the needle and/or looper thread, with which the task described before can be solved in an unforeseeable and favourable way.

According to a development of the invention it is intended that the liftable needles adjustable between two positions are arranged in the peripheral and/or central area of the needle bar. It turned out that additional patterns or pattern elements are especially favourable in these areas.

It makes for example an additional quilting in the peripheral area possible, especially favourable with multi-layer quilting material as an improved connection of the quilting material layers lying on top of each other is achieved.

Alternatively, it can be intended that the liftable needles adjustable between two positions are arranged on the needle bar alternately with needles not adjustable. Of course, it is also possible that all needles of one or all needle bars are adjustable between two positions.

According to another characteristic of the invention it is intended that the needles adjustable between two positions are adjustable through a drive. This drive of the needles adjustable between two positions preferably comprises a pump for a hydraulic or a pneumatic pressure medium and at least one linear motor. It can also be provided that each needle is driven by an own linear motor and that single needles are adjusted through a hydraulic and/or pneumatic control.

An optional variant intends that the drive is built as electromechanic drive, especially consisting of a toothed rack and an electric motor driven pinion meshing with the toothed rack.

According to another feature of the invention it is intended that the cutting device is built as cutting blade. It proved as particularly favourable arranging the cutting device at the looper or at a spreader allocated to the quilting element pair. If the cutting device is arranged at the looper, it could be brought in contact with the appropriate thread by an additional rotating movement of the looper shaft in order to cut the thread in a sufficient length from the latest connecting point between looper thread and needle thread.

Preferably it is finally intended with the chain stitch multi-needle quilting machine according to the invention that the quilting material support has a quilting material transport device serving the transport of the quilting material in at least two opposite directions. The quilting material on the quilting material support is moved forward in quilting direction with the quilting material transport device before the adjustable needles are being activated whereby additional thread is taken off a thread supply in order to pull the needle thread out to a length before cutting excluding an automatic opening of the thread chain.

As solution of the problem described before it is intended with a type-pursuant method, that after one stitch is finished, preferably after one pattern element is finished, at least one needle is transferred from a first position participating in the quilting procedure, in particular in the stitch forming, to a second position where the needle does not participate at least in the following stitch, preferably in the following pattern element with the needle thread being connected with the looper thread in such a way that an automatic opening of the last stitch is prevented.

Preferably the needle thread is knotted with the looper thread before or after the needle is transferred to the second lifted position. In the simplest case the knotting is effected by needle and looper thread being pulled tightly during the last stitch and thus pulled into the quilting material, for example, by the quilting material being transported while a needle thread loop is still tied around the looper. During the further transport it is favourable to release the needle and looper thread tension since otherwise the threads could break. Thereby it is prevented that the thread seam opens automatically by outer influences. Alternatively or supplementary it can be intended that the needle thread is cut after the seam and the last stitch are finished, and is located in a second position at the beginning of another pattern element. Once the needle thread being knotted with the looper thread, it can be cut relatively short. On the other hand, without knotting the needle thread with the looper thread, or if this knotting was only insufficiently executed, the needle thread is cut with a relatively long thread end.

According to another characteristic of the invention it is intended that the quilting material is moved in quilting direction, preferably before the beginning of the next pattern element, in order to pull the lengthened thread off a thread supply before the needle thread is knotted with the looper thread and/or cut. In this way, a sufficient length of the needle thread is provided that is sufficient for both the knotting with the needle thread and for the cutting procedure without the risk of an automatic opening of the thread chain and that the needle thread has a sufficient length for the next quilting of a pattern element.

Furthermore it is intended that several needles arranged on at least one needle bar are transferred from the first to the second position at the same time. It can also be intended that all needles are transferred from the first to the second position or reverse at the same time.

Moreover, a further characteristic of the method according to the invention provides that the needle(s) is/are moved hydraulically, pneumatically or electromechanically.

Finally it is intended that the needle or needles is/are controlled by a programmable control. The programmable control preferably runs in analogy to one or more patterns. According to this, it is intended that one or more patterns, comprising preferably a multitude of pattern elements, are stored for example in a computer. The data of these patterns are transmitted to a known transport device for the quilting material and to the needles so that a fully automatic control is possible without making changings on the machine necessary during the quilting procedure.

The control technology can also intend that the stored patterns or pattern elements are combined with each other and used for the control of the needles.

Further characteristics and advantages of the invention result from the following description of the appropriate drawing showing a preferred form of a invention-pursuant chain stitch multi-needle machine.

BRIEF DESCRIPTION OF THE DRAWINGS

The drawing shows:

FIG. 3B a section of a needle bar with several needles of the chain stitch multi-needle according to FIGS. 1 and 2, and exemplary drive therefor.

DESCRIPTION OF PREFERRED EMBODIMENTS

Figure 1:
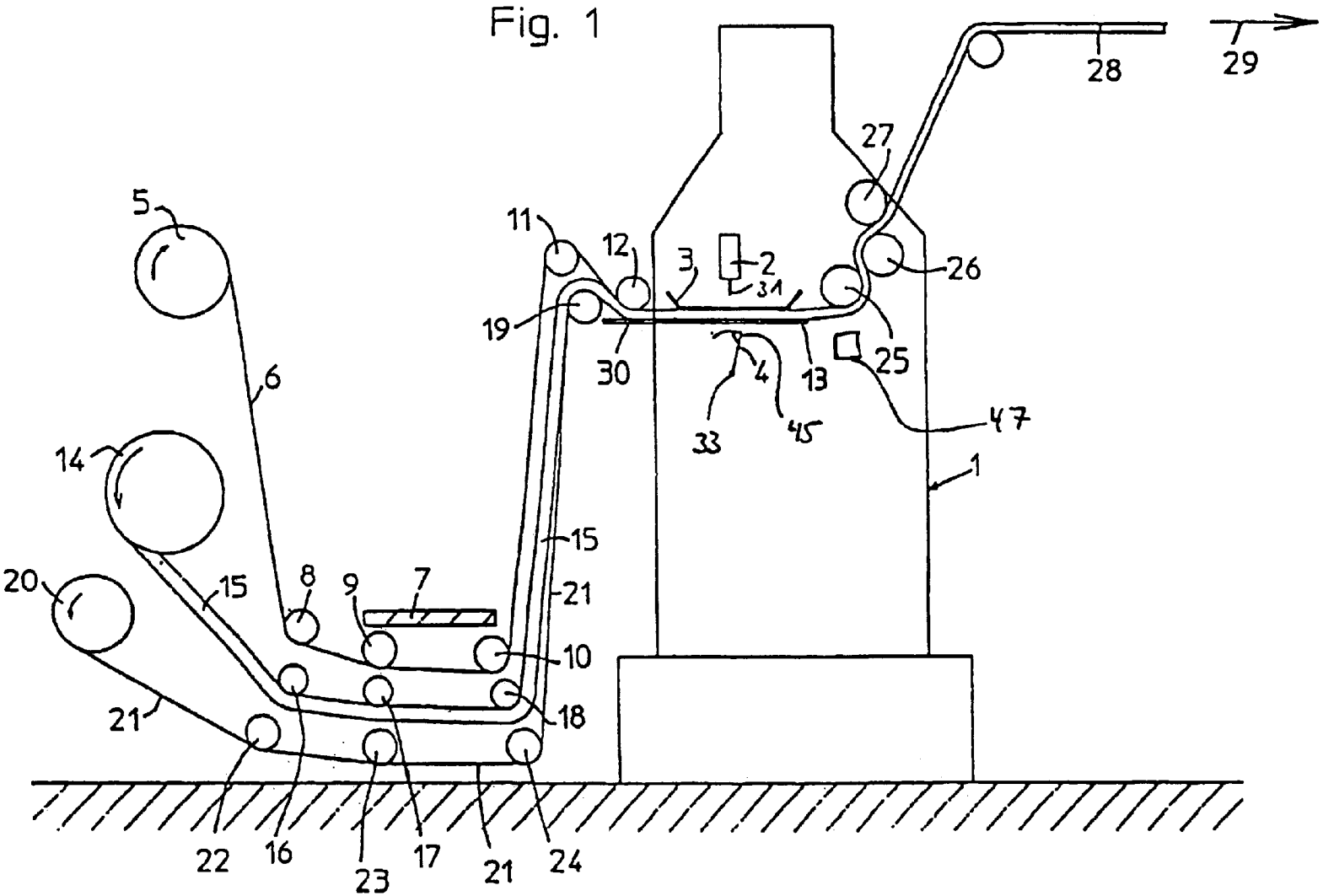
FIG. 1 a chain stitch multi-needle machine in a schematically represented side view.
Figure 2:
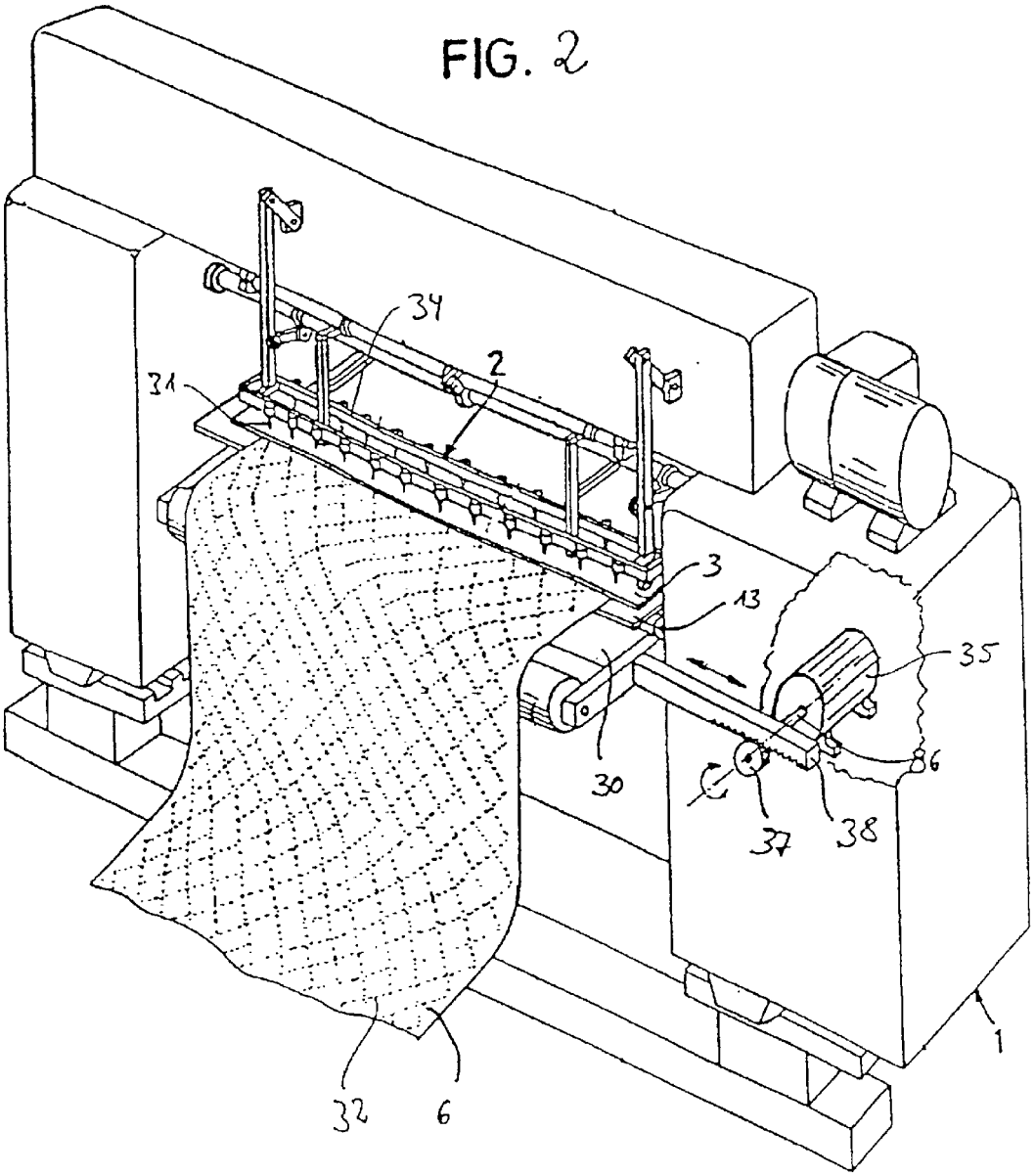
FIG. 2 the chain stitch multi-needle machine according to FIG. 1 in a perspective view.

A chain stitch multi-needle machine according to FIGS. 1 and 2 comprises a machine stand 1 with a needle bar 2 in the upper section with the single driven needles 31 are essentially being arranged side by side vertically to the focal plane. Sign 3 marks a common pressure foot, 4 a looper row according to needle row 2. A needle plate 13 or a sewing table is located below the layers of the quilting material fitted together in the quilting area. This needle plate 13 serves as quilting material support.

The quilting material consists of an upper layer 6, for example fabric, ticking or something similar and is pulled off a storage roll 5 and guided below a catwalk for the operator around deflection rollers 8, 9, 10, 11 and 12 into the quilting area, that is into the area between pressure foot 3 and the needle plate 13 or the quilting material support.

This layer 6 of the quilting material consists of inelastic material. In addition, the quilting material comprises a further layer 15 of elastic material, for example foam, which is stored on the storage roll 14. For this elastic layer too, guiding or deflection rolls 16, 17, 18 and 19 are provided.

The layer 15 of elastic material is quilted in the quilting unit with the upper layer of inelastic material and another layer 21, and is taken off the quilting unit as finished quilting material 28 in direction of arrow 29, whereby the feeding of layer 6, 15, and 21 is provided by the force acting on the finished quilting material 28. Behind the quilting unit, the finished quilting material 28 passes a section with deflection or guiding rolls 25, 26 and 27 providing among others a tightening of the quilting material 28 in the exit section of the quilting unit.

The lower layer 21 that is pulled off a storage roll 20 is fed into the quilting unit via deflection or guiding rolls 22, 23 and 24, whereby the lower layer 21 according to FIG. 1 can also be fed together with the upper layer 6 and layer 15 of the deflection roll 12 which will be described in detail below.

A support 30 is arranged opposite the deflection roll 12 with the distance to the outer circumference of the deflection roll 12 and the support 30 being adjustable, that is either the deflection roll 12 is movable relative to the support 30 or that the support 30 is movable relative to the deflection roll 12. Alternatively it can be intended that both the support 30 and the deflection roll 12 are adjustable in vertical direction. This variant serves the adjustement of the chain stitch multi-needle machine to differently strong layers 6 and 15 whereby the layer 15 consisting of elastic material is considerably stronger than the layer 6 consisting of inelastic material.

It is necessary that the deflection roll 12 acts on the layers 6 and 15 with a certain pressure in order to supply the necessary frictional forces.

FIG. 2 shows that the pressure foot 3 and the needle plate 13 or quilting material support in longitudinal direction of the machine stand 1 are not movable. On the contrary, the support 30 is movably arranged relative to the pressure foot 3 and to the needle plate 13 in longitudinal direction to the machine stand 1 so that the quilting material of which FIG. 2 only shows layer 6 consisting of inelastic material is movable relative to the needle rows 2 in such a way that any pattern can be transferred to the quilting material. In order to clarify this, layer 6 is shown with an example for a pattern to be quilted. To move the support 30 an electro motor 35 is provided containing on its driving shaft 36 a pinion 37 that combs a rack 38 which is firmly connected with support 30 with a toothed wheel.

Especially FIG. 2 shows that the needles 31 are arranged in two needle rows 2 running parallel to each other and are located behind each other in quilting direction. A looper of a looper row 4 is allocated to each needle 31. In this connection, looper row 4 is formed by a looper shaft 33 that is oscillatorily moved by an eccentric formed drive not described precisely. This oscillating movement is transferred to the loopers mounted on the looper shaft 33 with the loopers forming double chain stitches in the quilting material 28 together with the needles 31 oscillatorily moved up and down. For this, each needle 31 brings a thread, not described precisely, to the deepest point of its way located below the quilting material 28 in an area between the pressure foot 3 and the needle plate 13 so that the looper arranged there and allocated to the needle 31 can take a thread loop left there during the upward movement of the needle 31. While the needle 31 is being returned from its deepest position to its highest position, the looper moves into direction of the thread loop and takes a looper thread into the thread loop of the needle thread.

In the next step, the quilting material 28 is transported into the direction of arrow 29 before needle 31 is being moved again from its highest position to its deepest position. At this moment, the looper returns to its initial position with a thread triangle being formed of the thread loop of the needle thread and the looper thread in which the needle 31 enters. In this way a double chain stitch is formed consisting of a needle thread lying on the upper side of the quilting material and penetrating the quilting material and a looper thread lying on the lower side of the quilting material.

The single needles 31 of a needle row 2 are changeably fixed on a needle bar 34 so that the needle bar 34 can be fed with needles 31 according to the desired pattern 32. The same applies for the loopers that are also changeably fixed on the looper shaft 33.

In order to quilt particular patterns it is necessary that certain needles 31 are participating in the quilting procedure at times, and at times are not pricking into the quilting material 28. For this purpose it is provided according to FIGS. 3A and 3B that a part of the needles 31 is provided with a drive 39, 139 enabling that the needles 31 can be adjusted between two positions with the needles 31 participating in the quilting procedure in a first position and not pricking into the quilting material during the quilting procedure in a second position.

Figure 3A:
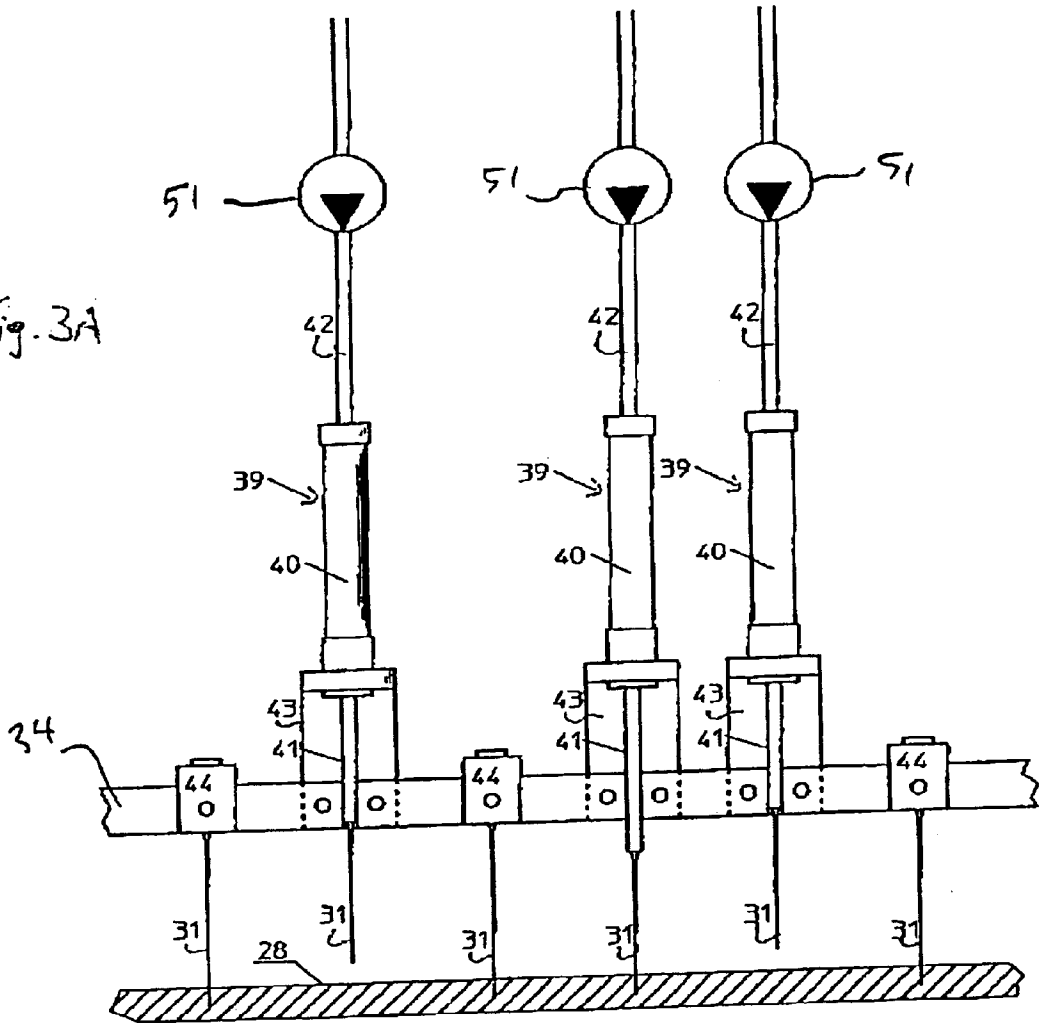
FIG. 3A a section of a needle bar with several needles of the chain stitch multi-needle according to FIGS. 1 and 2, and another exemplary drive therefor.
Figure 38:
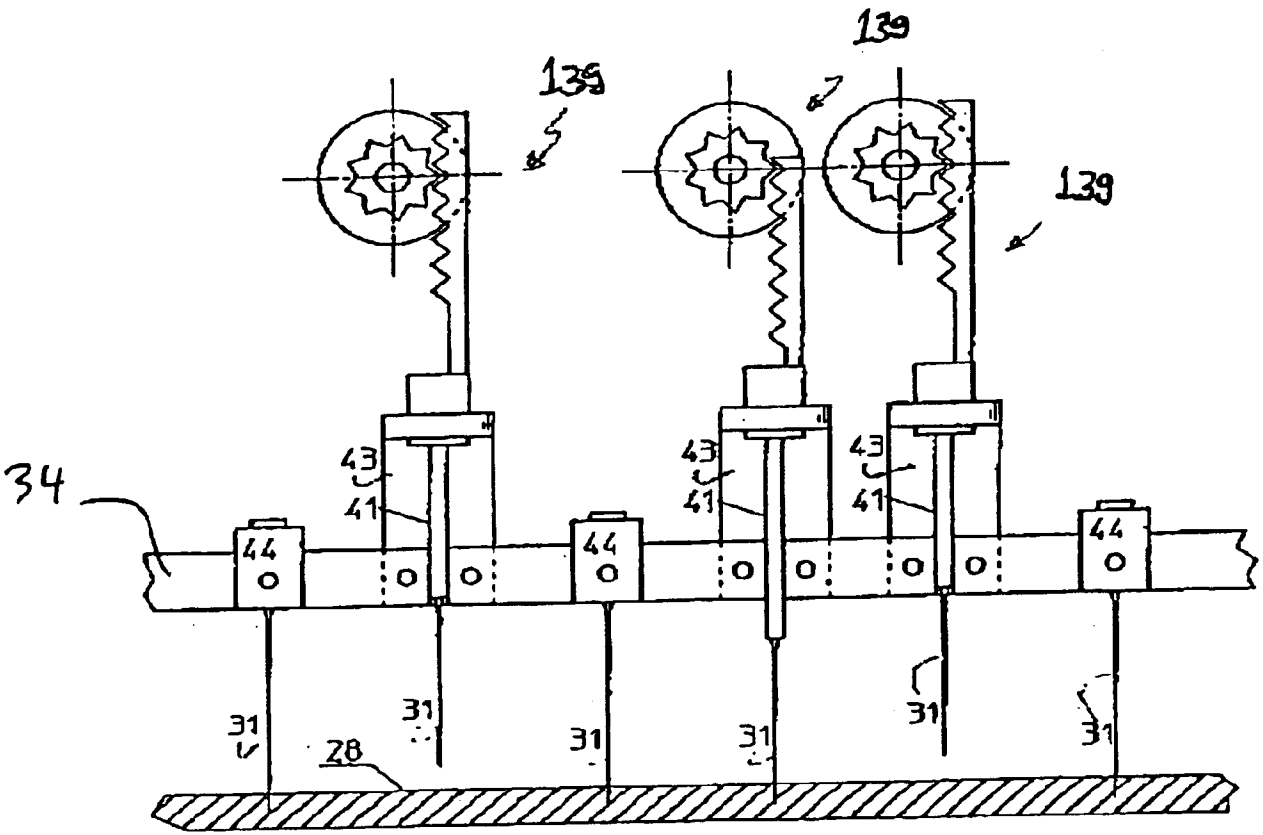

Referring to FIG. 3A, a pneumatic or hydraulic drive 39 preferably comprises a pump 51 for a hydraulic (non-compressible) medium or for a pneumatic pressure medium. Each needle 31 adjustable between two positions has its own such drive 39 consisting of a linear motor 40 having a pneumatically/hydraulically driven and spring-loaded piston 41 with the needle 31 inserted into an aligned bore-hole at its free end.

The piston 41 is provided with a spring, not described precisely, that is arranged between the lower end of drive 39 aligned to needle 31 and a piston disk; this spring holding the piston in its initial place in a position during which the needle 31 is not participating in the quilting procedure.

If the piston 41 is supplied with compressed air through an energy line 42, it moves contrary to the spring force of the spring, not described more detailed, into the direction of the quilting material 28, so that it holds, in this position, the needles in their first position where they participate in the quilting procedure. If the supply of compressed air to the piston 41 is interrupted, the spring, not described precisely, pushes the piston 41 back to its initial position described before.

The linear motors 40 are screwed with the needle bar 34 via L-shaped angle sheet metals 43. The independently adjustable needles may be arranged along the needle bar to suit the particular quilting applications, such as in the peripheral and/or central area of the needle bar. For example, FIG. 3A shows three needles 31 adjustable in their positions between two stationary needles 31 and one stationary needle 31 which therefore constantly participate in the quilting procedure. The stationary needles 31 are detachably fixed to the needle bar 34 with a needle holder 44. The needle holder 44 and the angle sheet metals are preferably fixed with screws detachable in an easy way.

In FIG. 3B, an alternate drive 139 is built as an electromechanical drive, preferably including a toothed rack and an electric motor driven pinion, meshing with the toothed rack.

In addition to the adjustable needles 31, the chain stitch multi-needle quilting machine according to the invention comprises a cutting device which is build as cutting blade 45 with each looper (or spreader) having such a cutting blade 45. To operate the cutting blades 45, it is intended that the looper shaft 33 executes an additional movement initiated by an eccentric drive during this movement the cutting blade 45 is brought into contact with the needle thread so that the needle thread is cut over it. It can also be provided that the cutting of the needle thread is effected by an additional movement of the quilting material 28 so that the tightened needle thread is pulled into and cut in the area of the cutting blade 45.

With the chain stitch multi-needle quilting machine described before, a method to create complicated patterns in a quilting material can be carried out in an easy way. In this connection it is favourable that additional seams can be made during the quilting procedure with the adjustable needles 31 without a change of the chain stitch multi-needle machine becoming necessary that additional needles 31 must be fixed to the needle bar 34.

After finishing a double chain stitch, the needle thread can be cut in the area of the needles 31 adjustable between two positions with the cutting blades 45 in a length avoiding an automatic opening of the thread chain. Alternatively or additionally, a knotting device (shown schematically at 47 (FIG. 1)) can be provided to knot the needle thread with the looper thread during the last stitch against automatic opening. In order to prepare a sufficiently long needle thread, it is provided that the quilting material is moved into the direction of arrow 29 during a first step after the last stitch forming of a pattern element to pull additional needle thread off a bobbin, not described more detailed. Afterwards, the needle thread is cut with the cutting blade 45 in a required length.

A variant of the invention was described before, during which the needles 31 are movable, that means liftable between a lower position directed towards the quilting material and an upper position, away from the quilting material. Certainly, the invention is not restricted to such a form. Further variants are rather possible with which at least one, preferably a multitude of needles is/are adjustable between two positions with the needle(s) participating in the quilting procedure in a first position and not pricking into the quilting material during the quilting procedure in a second position. For example, the needles 31 can be fixed slewably around a pivot on the needle bar 34. In this case, a linear motor touches at one end of the needle 31; this motor adjusts the needle 31 around a pivot relative to the needle bar from an essentially perpendicular orientation where the needle 31 participate in the quilting procedure into a turned position where the needle 31 is not participating in the quilting procedure. This turned position is taken for example by a turning of the position by 30° degrees from the vertical orientation into direction of the horizontal orientation of the needle relative to the needle bar. Of course, larger turning angles are possible as far as it is guaranteed that the needle 31 is not pricking into the quilting material in the turned position.

Alternative to this, a twisting of the needle 31 relative to the needle bar 34 can also be intended. In case of this variant, a rotational axis at which the needle 31 is coupled, runs parallel to the normal line of the plane of the needle bar 34 whereas the rotational axis with the alternative of the slewable needles 31 first described runs in longitudinal direction to the needle bar 34.

Both alternative forms offer the possibility that the twisting or turning of the needles is carried out by the drives mentioned before, for example hydraulic or pneumatic linear motors or electromechanic drives. Furthermore it is possible with these alternatives too that several needles 31 are movable by a joint drive or each needle by an allocated drive 39.

What is claimed is:

1. A chain-stitch multi-needle quilting machine with stitch-forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; the machine characterized by the fact that at least one of the needles is independently adjustable between two positions, said needle participating in the quilting procedure in the first position and not pricking into the quilting material in the second position during the quilting procedure; and a device to knot the needle thread with the looper thread is assigned to said needle adjustable between the two positions.

2. The chain stitch multi-needle quilting machine of claim 1 wherein a cutting device is adapted to cut at least one of the needle threads.

3. The chain stitch multi-needle quilting machine of claim 1 wherein a cutting device is adapted to cut at least one of the looper threads.

4. The chain stitch multi-needle quilting machine of claim 1 wherein a cutting device is adapted to cut at least one of the needle threads and at least one of the looper threads.

5. The chain stitch multi-needle quilting machine according to claim 1, wherein a plurality of the needles is adjustable between two positions.

6. The chain stitch multi-needle quilting machine according to claim 5, wherein said needles being positioned in at least one of the peripheral and central areas of the needle bar.

7. A chain-stitch multi-needle quilting machine with stitch-forming quilting elements comprising at least one needle bar with attached needles, and at least one looper shaft with attached loopers, wherein the needles and the loopers form quilting element pairs and are driven in such a way to build chain stitches, each chain stitch-formed with a needle thread and a looper thread in a quilting material, the machine characterized by the fact that at least one of the needles is adjustable between two positions, said needle participating in the quilting procedure in the first position and not pricking into the quilting material in the second position during the quilting procedure, and said needle arranged on the needle bar between other ones of the needles which are not adjustable; and a device to knot the needle thread with the looper thread is assigned to said needle adjustable between the two positions.

8. The chain stitch multi-needle quilting machine according to claim 1, characterized by the fact that said needle adjustable between two positions is adjustable through a drive.

9. The chain stitch multi-needle quilting machine according to claim 8, characterized by the fact that said drive comprises a pump for a non-compressible medium and at least one linear motor.

10. The chain stitch multi-needle quilting machine according to claim 9, characterized by the fact that said needle adjustable between the two positions includes a linear motor.

11. A chain-stitch multi-needle quilting machine with stitch-forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; the machine characterized by the fact that at least one of the needles is adjustable between two positions, said needle participating in the quilting procedure in the first position and not pricking into the quilting material in the second position during the quilting procedure, said needle adjustable between two positions is adjustable through a needle drive, wherein the needle drive is an electromechanical drive, comprising a toothed rack and an electric motor driven pinion meshing with the toothed rack; and a device to knot the needle thread with the looper thread is assigned to said needle adjustable between the two positions.

12. The chain stitch multi-needle quilting machine according to claim 1, further comprising a device for cutting wherein the cutting device is a cutting blade.

13. The chain stitch multi-needle quilting machine according to claim 1, characterized by the fact that the cutting device is arranged at the looper or at a spreader allocated to the quilting element pair.

14. The chain stitch multi-needle quilting machine according to claim 1, further comprising a quilting material support, the quilting material support including a quilting material transport device for transporting the quilting material in at least two opposite directions.

15. The chain stitch multi-needle quilting machine according to claim 1, further comprising a cutting device for the needle thread assigned to said needle adjustable between two positions.

16. A chain-stitch multi-needle quilting machine with stitch-forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; characterized by the fact that at least one of the needles is independently adjustable between two positions, said needle participating in the quilting procedure in a first position and not pricking into the quilting material in the second position during the quilting procedure; and a cutting device assigned to said needle adjustable between two positions.

17. The chain stitch multi-needle quilting machine of claim 16 wherein said cutting device is adapted to cut at least one of the needle threads.

18. The chain stitch multi-needle quilting machine of claim 16 wherein said cutting device is adapted to cut at least one of the looper threads.

19. The chain stitch multi-needle quilting machine of claim 16 wherein said cutting device is adapted to cut at least one of the needle threads and at least one of the looper threads.

20. The chain stitch multi-needle quilting machine according to claim 16, wherein a plurality of needles is adjustable between two positions.

21. The chain stitch multi-needle quilting machine according to claim 20, wherein said plurality of needles is positioned in at least one of the peripheral and central areas of the needle bar.

22. A chain stitch multi-needle quilting machine with stitch forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; characterized by the fact that at least one of the needles is adjustable between two positions, said needle participating in the quilting procedure in a first position and not pricking into the quilting material in the second position during the quilting procedure, and said needle arranged on the needle bar between other ones of the needles which are not adjustable; and a cutting device assigned to said needle adjustable between two positions.

23. The chain stitch multi-needle quilting machine according to claim 16, wherein said needle adjustable between two positions is adjustable through a drive.

24. The chain stitch multi-needle quilting machine according to claim 20, wherein the drive comprises a pump for a non-compressible medium and at least one linear motor.

25. The chain stitch multi-needle quilting machine according to claim 21, wherein said needle adjustable between the two positions includes a linear motor.

26. A chain stitch multi-needle quilting machine with stitch forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; characterized by the fact that a plurality of needles is adjustable between two positions;

at least one of the needles is adjustable between two positions, said needle participating in the quilting procedure in a first position and not pricking into the quilting material in the second position during the quilting procedure; and a cutting device assigned to said needle adjustable between two positions, wherein the needle drive is an electromechanical drive, comprising a toothed rack and an electric motor driven pinion meshing with the toothed rack.

27. The chain stitch multi-needle quilting machine according to claim 16, further comprising a device for cutting wherein the cutting device is a cutting blade.

28. The chain stitch multi-needle quilting machine according to claim 16, wherein the cutting device is arranged at the looper or at a spreader allocated to the quilting element pair.

29. The chain stitch multi-needle quilting machine according to claim 16, further comprising a quilting material support, the quilting material support including a quilting material transport device for transporting the quilting material in at least two opposite directions.

30. The chain stitch multi-needle quilting machine according to claim 16, wherein said needle adjustable between two positions is positioned in at least one of the peripheral and central areas of the needle bar.

31. The chain stitch multi-needle quilting machine according to claim 16, wherein said needle thread is assigned to said needle adjustable between two positions.

32. A chain-stitch multi-needle quilting machine with stitch forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; characterized by the fact that at least one needle is independently adjustable between two positions, said needle participating in the quilting procedure in a first position and not pricking into the quilting material in the second position during the quilting procedure;

a device to knot the needle thread with the looper thread; and a device assigned to at least one of said needle and looper, said device for cutting at least one of the looper thread and the needle thread.

33. The chain stitch multi-needle quilting machine of claim 32 wherein said cutting device is adapted to cut at least one of the needle threads.

34. The chain stitch multi-needle quilting machine of claim 32 wherein said cutting device is adapted to cut at least one of the looper threads.

35. The chain stitch multi-needle quilting machine of claim 32 wherein said cutting device is adapted to cut at least one of the needle threads and at least one of the looper threads.

36. The chain stitch multi-needle quilting machine according to claim 32, wherein a plurality of the needles is adjustable between two positions.

37. The chain stitch multi-needle quilting machine according to claim 36, wherein said plurality of needles is positioned in at least one of the peripheral and central areas of the needle bar.

38. A chain stitch multi-needle quilting machine with stitch-forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; characterized by the fact that at least one needle is adjustable between two positions, said needle participating in the quilting procedure in a first position and not pricking into the quilting material in the second position during the quilting procedure, and said needle arranged on the needle bar between other ones of the needles which are not adjustable;

a device to knot the needle thread with the looper thread;

and a device assigned to at least one of said needle and looper, said device for cutting at least one of the looper thread and the needle thread.

39. The chain stitch multi-needle quilting machine according to claim 32, wherein said needle adjustable between two positions is adjustable through a drive.

40. The chain stitch multi-needle quilting machine according to claim 39, wherein the drive comprises a pump for a non-compressible medium and at least one linear motor.

41. The chain stitch multi-needle quilting machine according to claim 40, wherein said needle adjustable between two positions includes a linear motor.

42. A chain stitch multi-needle quilting machine with stitch-forming quilting elements comprising at least one needle bar with attached needles, and at least one looper shaft with attached loopers, wherein the needles and the loopers form quilting element pairs and are driven in such a way to build chain stitches, each chain stitch formed with a needle thread and a looper thread in a quilting material; characterized by the fact that at least one needle is adjustable between two positions, said needle participating in the quilting procedure in a first position and not pricking into the quilting material in the second position during the quilting procedure; said needle adjustable between two positions is adjustable through a needle drive, wherein the needle drive is an electromechanical drive, comprising a toothed rack and an electric motor driven pinion meshing with the toothed rack;

a device to knot the needle thread with the looper thread; and a device assigned to at least one of said needle and looper, said device for cutting at least one of the looper thread and the needle thread.

43. The chain stitch multi-needle quilting machine according to claim 35, further comprising a cutting device wherein said device is a cutting blade.

44. The chain stitch multi-needle quilting machine according to claim 35, wherein the cutting device is arranged at the looper or at a spreader allocated to the quilting element pair.

45. The chain stitch multi-needle quilting machine according to claim 35, further comprising a quilting material support, the quilting material support including a quilting material transport device for transporting the quilting material in at least two opposite directions.

46. A method for creating a pattern in a quilting material in which at least one needle thread and one looper thread are connected to form a chain stitch by means of a multitude of quilting elements including at least one needle and one looper, characterized by the fact that after finishing a stitch, the needle is independently transferred from a first position participating in the quilting procedure to a second position where the needle does not participate in at least the following stitch, the needle thread being connected with the looper thread in such a way that an automatic opening of the last stitch is prevented before the beginning of the next pattern element.

47. The method according to claim 46, characterized by the fact that the needle thread is knotted with the looper thread before the beginning of the next pattern element.

48. The method according to claim 46, characterized by the fact that at least one of the needle thread and the looper thread is cut before the beginning of the next pattern element.

49. The method according to claim 46, characterized by the fact that at least one of the needle threads is cut before the beginning of the next pattern element.

50. The method according to claim 46, characterized by the fact that at least one of the looper threads is cut before the beginning of the next pattern element.

51. The method according to claim 46, characterized by the fact that at least one of the needle threads and at least one of the looper threads are cut before the beginning of the next pattern element.

52. The method according to claim 46, characterized by the fact that the quilting material is moved in a quilting direction in order to pull a lengthened needle thread off a thread supply before the needle thread is cut or knotted with the looper thread and cut.

53. The method according to claim 46, characterized by the fact that several needles arranged on at least one needle bar are transferred from the first to the second position at the same time.

54. The method according to claim 46, characterized by the fact that the needle is moved hydraulically, pneumatically or electromechanically.

55. The method according to claim 46, wherein the needle is controlled by a programmable control.

56. The method according to claim 55, characterized by the fact that the programmable control runs in analogy to one or more patterns.

57. The method according to claim 46, wherein the needle and looper thread is cut at least before the beginning of the next pattern element.

* * * * *